US005357937A

United States Patent [19]

Bauer et al.

[11] Patent Number: 5,357,937

[45] Date of Patent: Oct. 25, 1994

[54] METHOD FOR OPERATING AN INTERNAL COMBUSTION ENGINE UNDER FULL LOAD

[75] Inventors: Bernhard Bauer, Roetz; Ludwig Kettl, Aiterhofen; Stefan Krebs, Regensburg, all of Fed. Rep. of Germany

[73] Assignee: Siemens Aktiengesellschaft, Munich, Fed. Rep. of Germany

[21] Appl. No.: 139,194

[22] Filed: Oct. 19, 1993

[30] Foreign Application Priority Data

Oct. 19, 1992 [EP] European Pat. Off. ..... 92117861.2

[51] Int. Cl.[5] ..... F02D 41/00

[52] U.S. Cl. ..... 123/683; 123/681

[58] Field of Search ..... 123/681, 682, 683, 684

[56] References Cited

U.S. PATENT DOCUMENTS

| | | | |
|---|---|---|---|
| 4,470,395 | 9/1984 | Ohgami et al. | 123/683 X |
| 4,478,192 | 10/1984 | Kinoshita et al. | 123/684 |
| 4,488,529 | 12/1984 | Nishida et al. | 123/684 X |
| 4,936,278 | 6/1990 | Umeda | 123/683 |
| 4,993,393 | 2/1991 | Hosoda et al. | 123/684 X |
| 5,016,596 | 5/1991 | Fujimura et al. | 123/681 X |
| 5,067,465 | 11/1991 | Yamasaki et al. | 123/684 X |

FOREIGN PATENT DOCUMENTS

| | | |
|---|---|---|
| 0104336 | 9/1983 | Japan . |
| 0206953 | 3/1986 | Japan . |
| 9105153 | 4/1991 | PCT Int'l Appl. . |

*Primary Examiner*—Willis R. Wolfe

*Attorney, Agent, or Firm*—Herbert L. Lerner; Laurence A. Greenberg

[57] ABSTRACT

An internal combustion engine includes a lambda control device having a lambda sensor and a lambda control for regulating a fuel-air mixture to be supplied to an internal combustion engine to a set-point value, outside of full load operation, as a function of an output signal of the lambda sensor, and a mixture control device for setting the fuel-air mixture to a value being less than the set-point value, during full load operation of the internal combustion engine and with the lambda control switched off. A method for operating the internal combustion engine under full load includes continuously detecting and comparing the output signal of the lambda sensor with a rich and a lean threshold value, with the lambda control switched off, releasing the lambda control for a selectable number of mixture state changes, if the output signal of the lambda sensor falls below the lean threshold value during a period of time being greater than a preset value, and keeping the lambda control released until a mean value of the lambda control value indicates a rich main mixture.

2 Claims, 2 Drawing Sheets

METHOD FOR OPERATING AN INTERNAL COMBUSTION ENGINE UNDER FULL LOAD

BACKGROUND OF THE INVENTION

FIELD OF THE INVENTION

The invention relates to a method for operating an internal combustion engine under full load, having a lambda control device with a lambda sensor and a lambda control which, outside of full load operation, regulates a fuel-air mixture to be supplied to the internal combustion engine to a set-point value (lambda=1) as a function of an output signal of the lambda sensor, and a mixture control device which, during full load operation of the internal combustion engine and with the lambda control switched off, sets the fuel-air mixture to a value (lambda<1) which is less than the set-point value.

An internal combustion engine provides its maximum output under full load conditions. However, that is only achieved if the air-fuel mixture is enriched in contrast to partial load operation (rich mixture, deficiency of air about 10%).

In order not to exceed the threshold values for exhaust emissions that are required by law, modern internal combustion engines are equipped with a lambda control device for assuring the required exactitude of the mixture composition. Since in the course thereof the remaining oxygen content in the exhaust gas is continuously measured by means of a lambda sensor in a closed control circuit, and the amount of fuel supplied is corrected in such a way that a stoichiometric mixture (lambda=1) results, the lambda control device must be turned off at full load. In that operational stage the internal combustion engine is operated with a rich mixture pre-control. In order to provide correct mixture processing, fuel metering systems, fuel carburetor installations or injection systems require exact information regarding the actual load condition of the engine in order to add the correct amount of fuel to the aspirated air on the basis thereof. If in that case the amount of air aspirated per stroke is used as the load parameter, it is possible for the mixture pre-control to become too lean because of the incorrect detection of the air volume flow. Such incorrect measured values can arise, for example, if they are detected by means of rapidly responding measuring devices, such as hot-film air volume meters or hot-wire air volume meters. Due to the rapid response speed, the output signal of the air measuring device follows each pulse in the air flow. Thus, as soon as such pulses occur, the air measuring device may no longer provide correct measurement values which would be usable for mixture processing. The lambda control also cannot compensate for such incorrect load detection, because it is turned off in that operational stage of the internal combustion engine.

A method for improving the mixture control in special operational stages of an internal combustion engine is disclosed in Published International Application WO 91/05153. In that case the lambda control remains active within a limited control range even during controlled operation, and the lambda regulator is asymmetrically effective during such special operational stages, so that it only controls the fuel-air mixture in the "rich" direction.

SUMMARY OF THE INVENTION

It is accordingly an object of the invention to provide a method for operating an internal combustion engine under full load, which overcomes the hereinafore-mentioned disadvantages of the heretofore-known methods of this general type, which is operated by means of air volume-controlled injection and which at least assures a stoichiometric mixture, even with an incorrect detection of an air volume flow during full load operation.

With the foregoing and other objects in view there is provided, in accordance with the invention, a method for operating an internal combustion engine under full load, including a lambda control device having a lambda sensor and a lambda control for regulating a fuel-air mixture to be supplied to an internal combustion engine to a set-point value, outside of full load operation, as a function of an output signal of the lambda sensor, and a mixture control device for setting the fuel-air mixture to a value being less than the set-point value, during full load operation of the internal combustion engine and with the lambda control switched off, which comprises continuously detecting and comparing the output signal of the lambda sensor with a rich and a lean threshold value, with the lambda control switched off, releasing the lambda control for a selectable number of mixture state changes, if the output signal of the lambda sensor falls below the lean threshold value during a period of time being greater than a preset value, and keeping the lambda control released until a mean value of the lambda control value indicates a rich main mixture.

In accordance with a concomitant mode of the invention, there is provided a method which comprises using a position of a throttle flap as switch-off criteria for the lambda control when full load operation is being entered, and assuming full load operation if the throttle flap is deflected beyond a preset opening angle of the throttle flap.

It is possible by means of detecting and evaluating the output signal of the lambda sensor, even when the lambda control has been turned off, to detect errors in the mixture composition, such as leaning out of the mixture during full load operation, because of the incorrect detection of load parameters, and to correct them immediately, so that the mixture composition which is necessary for the correct operation of the internal combustion engine is assured.

Other features which are considered as characteristic for the invention are set forth in the appended claims.

Although the invention is illustrated and described herein as embodied in a method for operating an internal combustion engine under full load, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
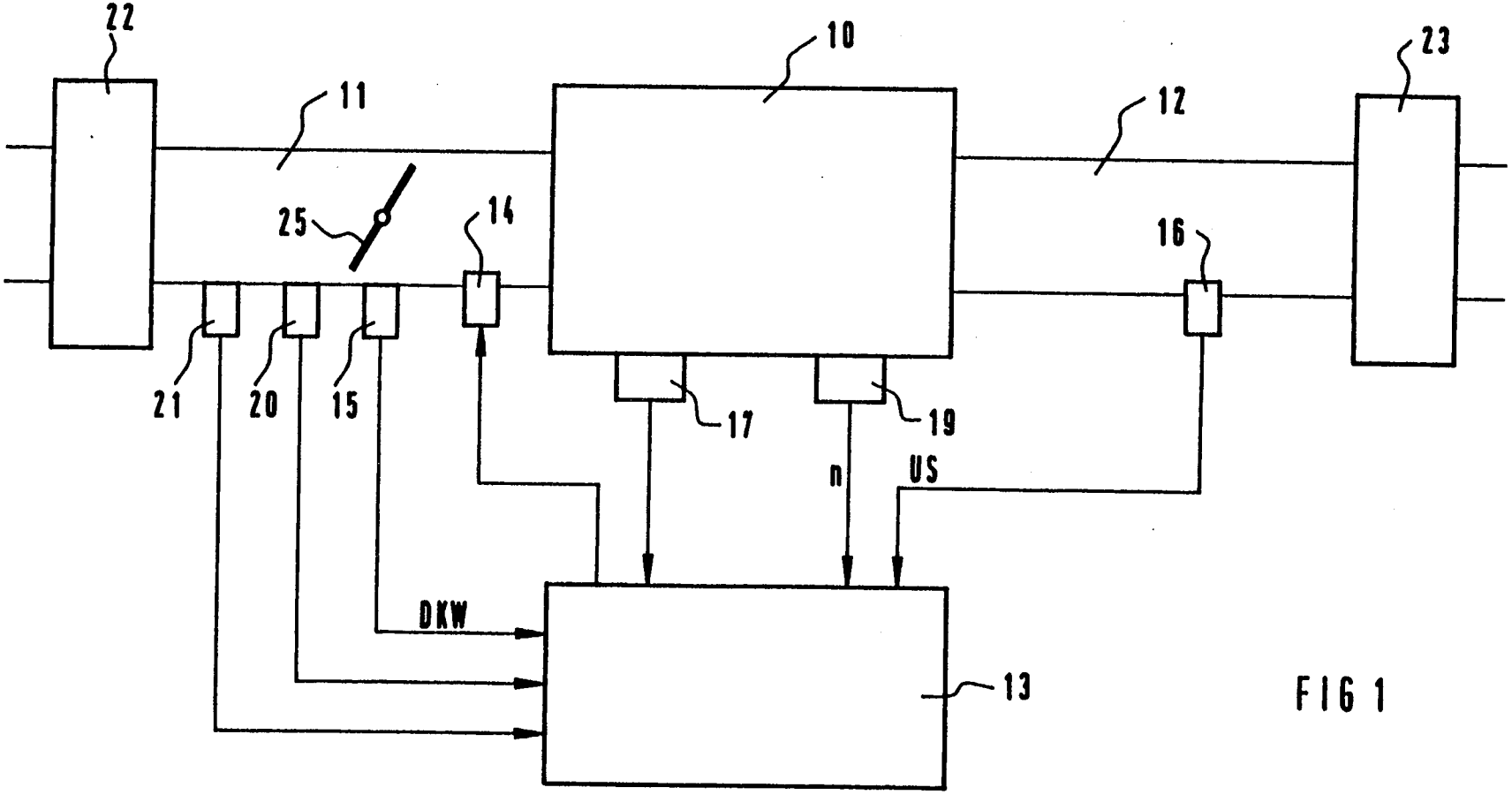
FIG. 1 is a greatly simplified schematic and block circuit diagram of an internal combustion engine with a configuration for executing the method of the invention.

Referring now to the figures of the drawing in detail and first, particularly, to FIG. 1 thereof, there is seen a configuration having an internal combustion engine 10, in which only those parts that are necessary for comprehending the method of the invention have been shown. Injection valves 14, of which only one is shown, are each assigned to a respective cylinder of the internal combustion engine 10. The injection valves are parts of a non-illustrated fuel circuit which includes a reservoir, a pressure regulator, a fuel pump, a fuel filter and appropriate lines, in a known manner. Combustion air is provided to the internal combustion engine 10 through an air filter 22, an aspiration conduit 11 and a throttle flap 25. In addition, an aspirated-air temperature sensor 20 and an air volume meter 21 are provided in the aspiration conduit 11. This air volume meter 21 can be constructed either as a hot-film air volume meter or a hot-wire air volume meter. In addition, a position sensor 15, which generates a signal corresponding to the opening angle of the throttle flap, is assigned to the throttle flap 25 for the detection of full load operation. In this case the position sensor 15 can be a throttle flap switch, which may be triggered independently of the rpm at a preset throttle flap opening angle or triggering may occur when the opening angle of the throttle flap is greater than an opening angle of the throttle flap which was preset as a function of the rpm of the internal combustion engine.

A three-way catalytic converter 23 is provided in an exhaust gas conduit 12 for separating out components HC, CO and $NO_x$ contained in the exhaust gases. A lambda sensor 16 has been inserted in the exhaust gas conduit 12 upstream of the three-way catalytic converter 23 for detecting the oxygen concentration in the exhaust gas. Furthermore, an rpm sensor 17 for detecting the engine rpm and a coolant temperature sensor 19 are provided at suitable locations in the internal combustion engine. The outputs of the above-mentioned sensors and the inputs of the above-mentioned control members are connected through interfaces with corresponding inputs and outputs of an electronic control device 13.

Such electronic control devices for internal combustion engines which, in addition to fuel injection, can also take over a multitude of other tasks (for example ignition regulation), are known per se, so that only the structure and mode of operation in connection with the instant invention will be addressed below.

The heart of the electronic control device 13 is a microcomputer, which controls the required functions in accordance with a set program. A main injection time or base injection time is calculated by means of the signals provided by the sensors (air meter and rpm sensor) and is processed in appropriate circuits, and corrections of this base injection time are made as functions of further operating parameters in such a way that during controlled operation, by use of the lambda control, a fuel-air mixture is achieved which corresponds to the stoichiometric ratio (lambda=1).

Figure 2:
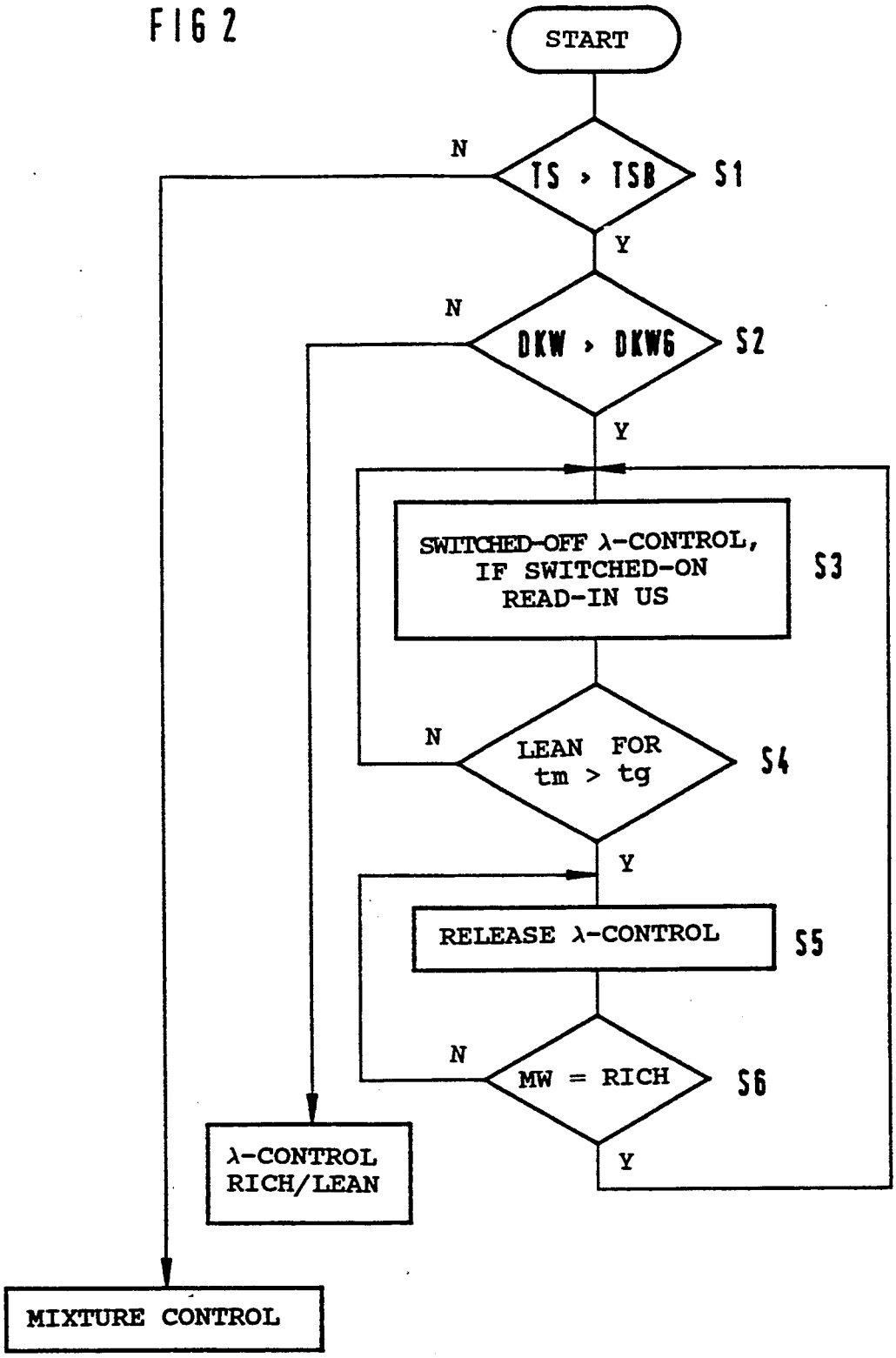
FIG. 2 is a flow diagram for executing full load enrichment.

Enrichment of the mixture during the full load operational stage will be explained with the aid of the flow diagram in FIG. 2.

In order to be able to perform a possibly required mixture control during full load operation, a check is made in a first step S1 as to whether or not the lambda sensor is ready to operate and whether or not the lambda control can be released at all if needed. If a sensor temperature TS is less than a sensor operating temperature TSB, operation of the internal combustion engine under mixture control or regulation is continued. However, if the lambda sensor has already reached its operating temperature TSB, a check is made in a second step S2 as to whether or not the internal combustion engine operates under full load. The opening angle of the throttle flap and the rpm of the engine are evaluated for this purpose. If a throttle flap opening angle DKW exceeds a preset threshold value DKWG, the assumption is that full load operation exists. If this information is negative in the step S2, then there is no full load operation and the internal combustion engine is operated under the conventional lambda control, if the requirements necessary for this (coolant temperature greater than the preset threshold, engine in quasi-stationary operation, engine not operated in an operational stage "thrust off") are present, which regulate the mixture to the stoichiometric ratio lambda =1. However, if full load operation has been recognized, the lambda control is switched off in a step S3, if it had been previously switched on, and with the lambda control switched off, an output signal US of the lambda sensor 16 is continuously detected and evaluated, i.e. it is compared with threshold values for rich or lean.

A check is then made in a step S4 on the basis of this evaluation, as to whether or not the mixture condition "lean" is present for a time tm which is greater than a preset time tg. If this is not the case, the lambda control remains switched off and the step S3 is again executed. In the other case, leaning out of the mixture under full load conditions is present, and in a step S5 the lambda control is released for at least a preset number of mixture state changes (reach to lean or lean to rich). It remains released until, in a step S6, a question whether or not a mean value MW of the lambda control value indicates an enriched main or base mixture has a positive answer. This indicates that the internal combustion engine is again operated with the rich mixture desired for full load operation, and the lambda control can be switched off again in the step S3, wherein the output signal US of the lambda sensor continues to be monitored.

We claim:

1. A method for operating an internal combustion engine under full load, including:

a lambda control device having a lambda sensor and a lambda control for regulating a fuel-air mixture to be supplied to an internal combustion engine to a set-point value, outside of full load operation, as a function of an output signal of the lambda sensor, and a mixture control device for setting the fuel-air mixture to a value being less than the set-point value, during full load operation of the internal combustion engine and with the lambda control switched off, which comprises:

continuously detecting and comparing the output signal of the lambda sensor with a rich and a lean threshold value, with the lambda control switched off, releasing the lambda control for a selectable number of mixture state changes, if the output signal of the lambda sensor falls below the lean threshold value during a period of time being greater than a preset value, and keeping the lambda control released until a mean value of the lambda control value indicates a rich main mixture.

2. The method according to claim 1, which comprises using a position of a throttle flap as switch-off criteria for the lambda control when full load operation is being entered, and assuming full load operation if the throttle flap is deflected beyond a preset opening angle of the throttle flap.

* * * * *